United States Patent [19]

Gorrafa

[11] 4,043,010

[45] Aug. 23, 1977

[54] PROCESS FOR PRODUCING TEXTURED POLYESTER YARN

[75] Inventor: Adly Abdel-Moniem Gorrafa, Hockessin, Del.

[73] Assignee: E. I. Du Pont de Nemours and Company, Wilmington, Del.

[21] Appl. No.: 697,945

[22] Filed: June 21, 1976

Related U.S. Application Data

[63] Continuation-in-part of Ser. No. 497,489, Aug. 14, 1974, Pat. No. 3,973,386.

[51] Int. Cl.[2] ..... D02G 1/16

[52] U.S. Cl. ..... 28/220; 28/240; 57/157 TS; 28/271

[58] Field of Search ..... 28/1.2, 1.3, 1.4, 72.12, 28/75 WT, 220, 240, 271; 57/140 B, 157 TS

[56] References Cited

U.S. PATENT DOCUMENTS

| | | | |
|---|---|---|---|
| 3,433,008 | 3/1969 | Gage | 28/75 WT |
| 3,772,872 | 11/1973 | Piazza | 57/157 TS |

*Primary Examiner*—Louis K. Rimrodt

[57] ABSTRACT

A process for drawing and air-jet bulking polyester yarn which has been spin-oriented by melt-spinning at high speed. The yarn is drawn while heating it with a heater at a temperature greater than 180° C and the drawn yarn is immediately air-jet textured to produce crunodal surface loops. Boil-off shrinkages of less than 3.5 percent are obtained without heating the yarn after it is drawn.

4 Claims, No Drawings

PROCESS FOR PRODUCING TEXTURED POLYESTER YARN

REFERENCE TO RELATED APPLICATION

This application is a continuation-in-part of copending application Ser. No. 497,489 filed Aug. 14, 1974 (now U.S. Pat. No. 3,973,386, granted Aug. 10, 1976).

BACKGROUND OF THE INVENTION

This invention relates to production of polyester textile yarn and is more particularly concerned with drawing and air-jet texturing continuous filament yarn.

Textured yarn of continuous polyester or nylon filaments is produced by a sequence of steps which involve melt-spinning the polymer into filaments, combining filaments into a yarn, drawing the yarn to provide improved tenacity with a suitable low break elongation, and then texturing the yarn, e.g., to have the appearance and feel similar to costlier spun staple textile yarns. FIG. 1 of Gage U.S. Pat. No. 3,433,008 is a schematic representation of this sequence of steps combined in a continuous operation. Conventionally, the spinning and texturing steps are performed in separate operations. The drawing step may be coupled with the texturing step as shown in FIG. 3 of the patent, or drawing may be coupled with spinning as shown in FIG. 4.

As disclosed in Ludewig "Polyester Fibres," English translation, 1971, John Wiley & Sons Ltd., pages 275–276, drawn polyester filaments which have not been set cannot be used for most textile purposes because of their high shrinkage, a boil-off shrinkage of about 8 percent being obtained even when heat is used during the drawing step. For most textile uses the boil-off shrinkage should be less than 3.5 percent.

Texturing can be accomplished by treating yarn in a jet of heated gas as disclosed in Breen and Lauterbach U.S. Pat. No. 3,543,358. As illustrated in FIG. 2 of this patent, the yarn can be drawn and passed directly to a jet texturing device. In Example I a jet device supplied with superheated steam at 575° F (302° C) was used to impart a three-dimensional curvilinear crimp to drawn nylon filaments. When subsequently heat-relaxed in steam, in the test described at column 12, line 52, to column 13, line 25, a high degree of bulk was obtained but the cross-sectional area of the filaments increased 14%, i.e., the filament shrinkage was 14 percent. Example IX gives data for crimping drawn polyethylene terephthalate yarn with a jet device supplied with steam at 495° F (257° C); the results of subsequent heat-relaxing treatment are not given, but the filament shrinkage would be about 8 percent or more.

It has been conventional to melt-spin polyester into yarn at a take-off speed (the puller roll speed for pulling the yarn filaments away from the spinneret) of 500 to 1500 meters per minute. German O.S. Pat. No. 2,204,397 (laid open Aug. 9, 1973) discloses a coupled spinning and drawing process in which polyester yarn is melt-spun at a take-off speed higher than 3000 meters per minute and then drawn at a draw ratio between 1.8x and 1.3x. In the process illustrated with reference to FIG. 1, the drawing step is performed in a steam atmosphere at 145° C. The object of the invention is stated to be to retain the advantages of the customary melt-spinning and subsequent drawing while attaining an increase in the take-off and production speed without influencing the quality of the product. The patent mentions that, in accordance with the state of the art, further treatments may be used to dye, reduce shrinkage, texturize or crimp the yarn filaments, but no details are given.

SUMMARY OF THE INVENTION

In a process for producing textured textile yarn from undrawn continuous filament yarn by drawing the yarn and air-jet texturing the drawn yarn to form a bulky yarn having crunodal surface loops, the present invention is an improvement for producing bulky polyester textile yarn having a boil-off shrinkage of less than 3.5 percent without heating the yarn after the yarn is drawn. The improvement comprises continuously drawing undrawn spin-oriented polyester yarn at 1.3 to 2.0 draw ratio while heating the yarn with a heater at a temperature greater than 180° C and feeding the drawn yarn directly to an air-jet at 8 to 35 percent overfeed without additional heating, jet texturing the yarn with the air jet to form crunodal surface loops in the yarn, and packaging the resulting textured yarn at a package speed (P) greater than the takeup speed (T) from the air-jet, the value of $(T-P)/T$ (100) being from $-1$ to $-10$ percent.

It is quite surprising that the process produces bulky polyester yarn having a boil-off shrinkage of less than 3.5 percent. This is of particular importance in package dyeing since yarns having higher boil-off shrinkages take up dye non-uniformly. The shrinkage of prior art yarns has been excessive (about 8 percent or more), and throwsters have been forced to either heat set the yarn or wind soft packages under sufficiently low tension so that the yarn could shrink uniformly during package dyeing. Such soft packages are more difficult to handle and less economical to produce. The low boil-off shrinkage obtained by the present process makes possible the winding of normal firm packages, without heat-setting the yarn, which provide excellent dyeability in package dyeing.

A conventional bulking jet supplied with un-heated air is suitable for texturing the drawn yarn to form crunodal surface loops. The efficiency of the air-jet can be improved by wetting the yarn as it passes to the air jet. About 20 percent overfeed to the air-jet is usually desirable.

The undrawn spin-oriented feed yarn for the process of this invention is preferably yarn which has been melt-spun from synthetic linear ethylene terephthalate polymer at 3000 to 5000 yards per minute (2750–4570 meters/minute) and is characterized by a break elongation of 70 to 180 percent, a birefringence value of at least 0.025, a crystallinity of less than 30 percent, and a relative viscosity of at least 18.

DEFINITIONS AND MEASUREMENTS

Break elongation and tenacity are measured according to the ASTM designation D-2256-69 (incorporating editorial edition of Section 2 and renumbering of subsequent sections as done in Mar. 1971). It is defined as in Option 3.3 "Elongation at Break" of Section 3. The testing is performed on straight multifilament yarns which were conditioned by storing them at 65 percent relative humidity and 70° F (21.1° C) for 24 hours prior to testing. An Instron Tensile Testing Machine is used. The test sample is 5 inches (12.7 cm) long, no twist is added, the cross-head speed is 10 inches/minute (25.4 cm/min), the rate of attenuation is 200 percent/minute, and the chart speed is 5 inches/minute (12.7 cm/min.).

Tenacity is the maximum load in grams, before the yarn breaks, divided by the denier of the yarn.

Birefringence is measured by the retardation technique described in "Fibres from Synthetic Polymers" by R. Hill (Elsevier Publishing Company, New York, 1953), pages 266–8, using a polarizing microscope with rotatable stage together with a Berek compensator or cap analyzer and quartz wedge. The birefringence is calculated by dividing the measured retardation by the measured thickness of the fiber, expressed in the same units as the retardation. For samples in which the retardation technique is difficult to apply because of nonround fiber cross section, presence of dye in the fiber, etc., an alternative birefringence determination such as Becke line method described by Hill may be employed.

Crystallinity may be measured by simple density measurements, for example, by the method described in "Physical Methods of Investigating Textiles," R. Meridith and J. W. S. Hearle, Textile Book Publishers, Inc., 1959 at pages 174–176. Carbon tetrachloride and n-heptane are suitable liquids for use with polyethylene terephthalate. The percent crystallinity is derived from the density measurements by linear interpolation between the density of a fully amorphous sample (1.335 gm/cc) and the density of the crystalline phase (1.455 gm/cc). For copolymers of fibers containing additives such as $TiO_2$ appropriate adjustments can be made such as described in Kitson et al. U.S. Pat. No. 3,549,597 at columns 4 and 5.

Boil-off shrinkage is obtained by suspending a weight from a skein of yarn to produce a 0.1 gm/denier load on the yarn and measuring its length ($L_o$). The weight is then replaced by a lighter weight producing a 0.005 gm/denier load and the loaded yarn is immersed in boiling water for 30 minutes. The yarn is then removed, air dried, loaded again with the original weight, and its new length recorded ($L_f$). The percent shrinkage is calculated by using the formula:

$$\text{Shrinkage (\%)} = (L_o - L_f)/L_o \times 100$$

Relative viscosity (RV) values are given as a measure of the molecular weight of the polyesters used. Relative viscosity (RV) is the ratio of the viscosity of a solution of 0.8 gm of polymer dissolved at room temperature in 10 ml of hexafluoroisopropanol containing 80 ppm $H_2SO_4$ to the viscosity of the $H_2SO_4$ containing hexafluoroisopropanol itself, both measured at 25° C in a capillary viscometer and expressed in the same units.

Interlace pin count is the length of yarn in inches that passes by probe 18 of Hitt U.S. Pat. No. 3,290,932 before the probe is deflected about 1 mm. A force of about 8 grams is required to deflect the probe.

The feed yarn is preferably interlaced, e.g., as described in Bunting et al. U.S. Pat. No. 2,985,995.

The drawing step of this invention is conveniently done on a commercially available false-twist-texturing machine without using a twist spindle or a stabilizing heater after drawing. Suitable machines are, for example, the ARCT 479 and 480, manufactured by Ateliers Roannais de Construction Textiles, of France, a Leesona false-twist texturing machine of the type shown in Chalfant et al U.S. Pat. No. 3,292,354, or the Scragg Super-Draw Set II (SDS II), available from Ernest Scragg & Sons, Macclesfied, England.

In the drawing step of the present invention, the yarn is drawn at a draw ratio of 1.3 to 2.0X while being heated with a heater set at a temperature of at least 180° C, preferably about 210° C. A snubbing pin may be used at the heater entry to localize the draw point in the yarn if needed.

A conventional bulking jet supplied with unheated air can be used to produce crunodal surface loops. Suitable bulking jets are described in Lubach U.S. Pat. No. 3,545,057 and Becher U.S. Pat. No. 3,097,412. To improve the efficiency of the jet, the yarn is preferably first passed through a water bath although this is not an essential aspect of the present invention. The percent overfeed to the jet; that is, $$\frac{\text{Feed Speed Minus Take-off Speed}}{\text{Feed Speed}} \times 100$$

can be set as desired, from about 8 to about 35, but is preferably about 20. The yarn is preferably underfed to the package to provide a firm package. Percent underfeed; that is, $$\frac{\text{Take-off Roller Speed Minus Package Speed}}{\text{Take-off Roller Speed}} \times 100$$

can be set as desired, from about −1 to about −10, but preferably is about −5.

EXAMPLES

Spin-oriented polyethylene terephthalate yarns are made by standard melt-spinning techniques except that the freshly extruded filaments are pulled from the spinneret by means of puller rollers running at very high speed. Quenching is by a forced flow of 21.1° C air. The puller rollers are about 20 feet (6.1 m) below the spinneret. Downstream of the puller rollers the yarns contact a roller immersed in a finish bath.

Finish is an aqueous solution comprising 12% of a mixture of 97 parts of a 2900 number average molecular weight polyoxyalkylene block copolymer: $HO(C_2H_4O)_m(C_3H_6O)_n(C_2H_4O)pH$, wherein m, n, and p are integers, consisting of 40% (all percentages herein are by weight) oxyethylene and 60% oxy-1,2-propylene groups. The mixture also contains 1 part sodium dioctylsulfosuccinate, 0.5 part triethanol amine, 0.5 part oleic acid, 0.5 part 4,4'butylidene-bis-(6-t-butyl-m-cresol) and 0.5 part tris(nonylphenyl)phosphite.

Just before windup, the yarns pass through an interlace jet supplied with room temperature air at 20 psig (1.406 kg/m²) pressure to produce 40-inch (102 cm) interlace pin count.

The polymer in these yarns is less than 30% crystalline.

Three of the spin-oriented yarns are drawn on a commercial false-twist texturing ARCT-480 machine having no twist spindle. As the yarns exit from the draw zone, equipped with typical 40 inch (100 cm) heater, they bypass the second heater and are fed directly through a wetting trough to bulking jets and are finally wound up on the standard paper tube using "underfeed to package" as shown in the Table.

Process and product details are shown in the Table. The yarn of each sample contains desirable surface loops and, surprisingly, even though a heat-setting step is not used, all yarns have less than 3.5% boil-off shrinkage.

Sample one is a bulky loopy yarn of 186 denier and has 2.5% boil-off shrinkage. The yarn was prepared for pressure package dyeing by rewinding using no special pecautions such as those required to produce a very soft package. The yarn is dyed red and dye uniformity is excellent. The dyed yarn is made into doubleknit Ponte-di-Roma fabric which is worsted-like and possesses other desirable tactile aesthetics.

Sample two processed through a different air jet (Table) and has 3.1% boil-off shrinkage. The yarn is knitted, in the greige, to Ponte-di-Roma doubleknit fabric. The fabric is beck scoured then dyed in a pressure jet dyer, dried, heat set, re-scoured with the addition of a surface softener, and finally dried. The finished fabric is worsted-like and possesses other desirable tactile aesthetics, and does not show shrinkage and weight increase typical of high boil-off shrinkage (about 8%) air-jet bulked polyester yarns of the prior art.

Sample three is a bulky, loopy yarn of 189 denier and has 3.0% boil-off shrinkage. The yarn is prepared for pressure package-dyeing as for Sample 1, using no special precautions, such as the previously required very soft package. The yarn is dyed brown. Dye uniformity is excellent. The yarn is made into doubleknit Ponte-di-Roma fabric which is worsted-like and possesses other desirable tactile aesthetics.

crunodal surface loops; the improvement for producing polyester textured yarn having a boil-off shrinkage of less than 3.5 percent without heating the yarn after the yarn is drawn, which comprises continuously feeding to the drawing step a spin-oriented polyester yarn characterized by a break elongation of 70 to 180 percent, a birefringence value of at least 0.025, a crystallinity of less than 30 percent, and a relative viscosity of at least 18, drawing the spin-oriented polyester yarn at 1.3 to 2.0 draw ratio while heating the yarn with a heater at a temperature from 180° to about 210° C and feeding the drawn yarn directly to an air jet at 8 to 35 percent overfeed without additional heating, jet texturing the yarn with the air jet to form crunodal surface loops in the yarn, and packaging the resulting textured yarn at a package speed (P) greater than the take-off speed (T) from the air jet, the value of (T−P)/P (100) being from −1 to −10 percent.

2. A process as defined in claim 1 which includes wetting the drawn yarn as it passes to the air jet.

3. A process as defined in claim 2 wherein the drawn yarn is jet textured at about 20 percent overfeed.

| Feed Yarn and Process | | | |
|---|---|---|---|
| Sample Number | 1 | 2 | 3 |
| Polymer RV | 20 | Same | Same |
| $TiO_2$ content (by wt.) | 0.3% | | |
| Spinneret temperature | 290° C. | | |
| Spinneret orifice size | 11×20 (.27×.51) | | |
| Diameter × length (mils)/(mm.) | | | |
| Puller roll speed (yd./min.)/(m./min.) | 3400 (3110) | | |
| Windup speed (yd./min.)/(m./min.) | 3400 (3110) | | |
| RV of polymer in yarn | 20 | | |
| Denier/number of filaments | 245/68 | | |
| Non-aqueous finish on yarn (wt. %) | 0.6% | | |
| Break elongation (%) | 126% | | |
| Birefringence | ~ .040 | | |
| Boil-off shrinkage (%) | ~ 55% | Same | Same |
| **Drawing Process** | | | |
| Machine Type | ARCT-480 | ARCT-480 | ARCT-480 |
| First heater temperature (° C.) | 210 | 210 | 210 |
| Draw roller speed (yd./min.)/(m./min.) | 150 (137) | 190 (174) | 190 (174) |
| Draw ratio | 1.65X | 1.65X | 1.60X |
| Machine second heater | Not used | Not used | Not used |
| **Air Jet Process** | | | |
| Air-bulking jet Patent reference | U.S. 3,545,057 | U.S. 3,097,412 | U.S. 3,545,057 |
| Overfeed to jet (%) | 25 | 22 | 22 |
| Air pressure to jet (psig)/(kg./cm²) | 80 (5.4) | 74 (5.0) | 80 (5.4) |
| Underfeed to package (%) | −5 | −5 | −5 |
| Package windup speed (yd./min.)/(m./min.) | 118 (108) | 153 (140) | 153 (140) |
| Bulked yarn boil-off shrinkage (%) | 2.5 | 3.1 | 3.0 |
| Bulked yarn denier | 186 | 181 | 189 |

I claim:

1. In a process for producing textured textile yarn fron undrawn continuous filament yarn by first drawing the yarn without texturing the yarn and then air-jet texturing the drawn yarn to form a bulky yarn having

4. A process as defined in claim 1 wherein the spin-oriented yarn has been melt-spun from synthetic linear ethylene terephthalate polymer at 3000 to 5000 yards per minute.

* * * * *